US005114193A

United States Patent [19]

Nass

[11] Patent Number: 5,114,193

[45] Date of Patent: May 19, 1992

[54] SAFETY LATCH MECHANISM

[76] Inventor: Thomas O. Nass, 14502 La Cuarta, Whittier, Calif. 90605

[21] Appl. No.: 627,597

[22] Filed: Dec. 14, 1990

[51] Int. Cl.[5] ..... E05C 5/00

[52] U.S. Cl. ..... 292/67; 292/DIG. 71

[58] Field of Search ..... 292/62, 63, 67, 57, 292/238, 306, DIG. 71

[56] References Cited

U.S. PATENT DOCUMENTS

| | | | |
|---|---|---|---|
| 875,087 | 12/1907 | Mackintosh | 292/57 |
| 952,411 | 3/1910 | Billy | 292/62 |
| 1,548,907 | 8/1925 | Schweim | 292/62 |
| 1,654,913 | 1/1928 | Beemer | 292/57 |
| 1,898,934 | 2/1933 | Bohman | 292/121 X |
| 2,403,065 | 7/1946 | Engert | 292/57 |
| 2,716,038 | 8/1955 | Sawyer | 292/62 |
| 2,981,560 | 4/1961 | Wehner | 292/67 X |
| 4,639,023 | 1/1987 | Boisvert | 292/DIG. 38 X |

*Primary Examiner*—Richard E. Moore

[57] ABSTRACT

A latch mechanism for maintaining laboratory storage units, such as refrigerators, incubators and cabinets in a closed configuration when such units are subjected to a sudden force or shock. The latch mechanism generally comprises a base member which is adapted to be easily and quickly interfaced to existing laboratory storage units. Connected to the base member is a latch member which is movable between a locked position and an unlocked position. The latch member includes a stop member attached thereto for maintaining the latch member in a fixed orientation within the base member. The latch mechanism is constructed to provide a holding force which may not be easily overcome and is further constructed so as to provide a quickly ascertainable visual indication of whether the storage unit is in a closed configuration.

22 Claims, 2 Drawing Sheets

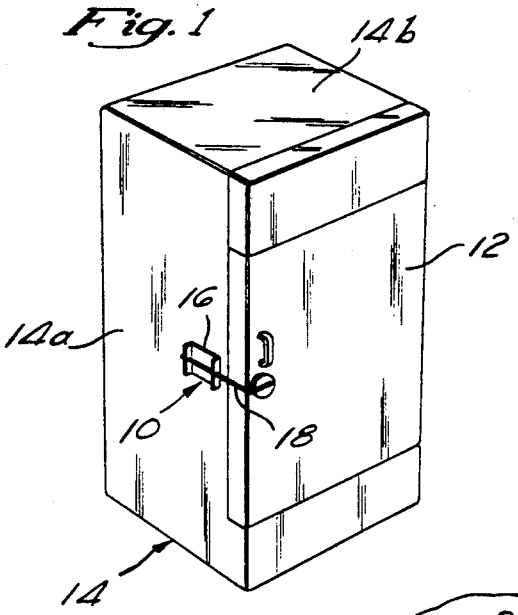
Fig. 1
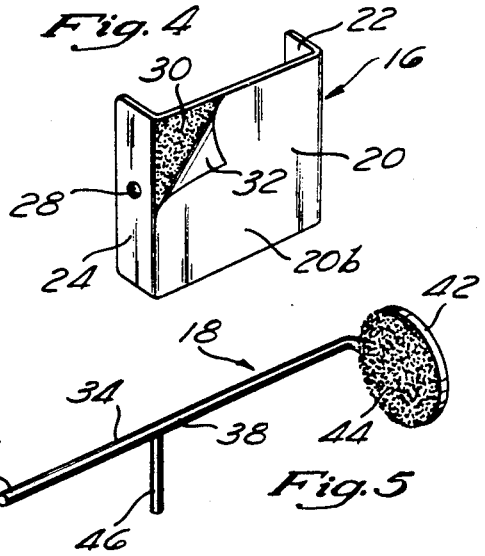
Fig. 4
Fig. 5
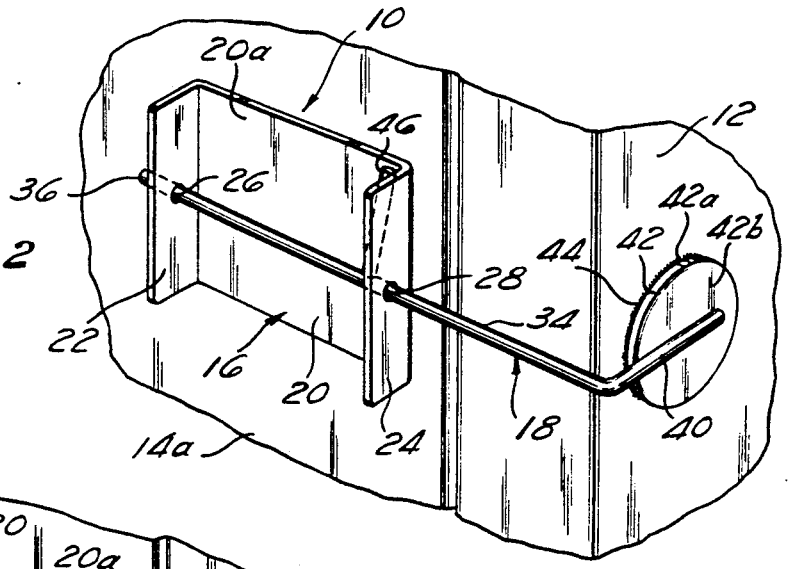
Fig. 2
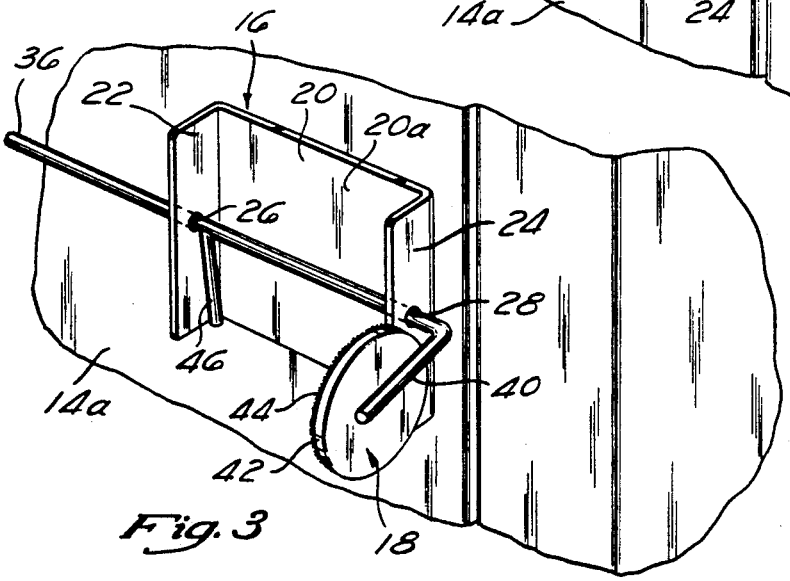
Fig. 3

SAFETY LATCH MECHANISM

FIELD OF THE INVENTION

The present invention relates generally to latch mechanisms, and more particularly to a safety latch for maintaining laboratory storage units and the like in a closed configuration.

BACKGROUND OF THE INVENTION

Many scientific laboratories are equipped with laboratory storage units for purposes of storing hazardous, toxic or biologically sensitive and/or degradable materials which are being used or studied in a clinical/-laboratory environment. Such storage units include cabinets and drawers as well as environmentally controlled units such as refrigerators, humidifiers, and incubators. Due to the nature of the materials typically stored in such units and the health risks some of these materials may impose upon laboratory personnel if not properly contained, it is important that any laboratory storage unit used to contain such materials be constructed in a manner adapted to prevent the unit from disgorging its contents or breaching the controlled environment therewithin when the unit is subjected to a sudden force or shock.

Typically, laboratory storage units such as refrigerators, incubators and cabinets are equipped with magnetic latches to maintain the units in a closed configuration. However, because of the relatively low holding force exerted by such magnetic latches, such latches will oftentimes fail when the storage unit is bumped or otherwise subjected to sudden movement as would occur during an earthquake (i.e. seismic activity). Additionally, magnetic latches, as well as other latching mechanisms, are not adapted to provide a clearly visible indication that the storage unit is in a closed configuration. This deficiency is particularly significant with respect to refrigerators wherein oftentimes the refrigerator door is left slightly ajar when an article is removed therefrom. In this regard, materials stored within the refrigerator may become contaminated or degraded before a laboratory technician may discover that the door has not been properly closed.

Thus, there exists a need in the art for a latch mechanism which is operable to maintain laboratory storage units in a closed configuration, wherein the latch mechanism exerts a holding force which cannot easily be overcome and also provides a visual indication as to whether the storage unit is in a closed configuration.

SUMMARY OF THE INVENTION

In accordance with the preferred embodiment of the present invention, there is provided a latch mechanism for maintaining laboratory storage units in a closed configuration when such units are subjected to sudden forces or shocks such as those encountered during seismic activity. Advantageously, the latch mechanism of the present invention is further adapted to provide a visual indication to a laboratory technician as to whether the storage unit is in the closed configuration.

The latch mechanism generally comprises a base member which is adapted to be securable to a generally planar surface of the storage unit. The base member comprises a generally planar center portion which defines an inner surface and an outer surface. Extending perpendicularly from the inner surface of the center portion is a first flange portion which includes a first aperture extending therethrough. Also extending perpendicularly from the inner surface of the center portion is a second flange portion which is substantially parallel to the first flange portion. Extending through the second flange portion is a second aperture which is coaxially aligned with the first aperture disposed in the first flange portion. The outer surface of the center portion includes an adhesive layer thereon for securing the base member to the planar surface of the storage unit. In the preferred embodiment, the base member is a unitary structure with the first flange portion and the second flange portion being formed on the opposed ends of the center portion.

Connected to the base member is a latch member which is movable between a locked position and an unlocked position. The latch member is operable to maintain the storage unit in a closed orientation while in the locked position, and allows the storage unit to be readily opened when in an unlocked position. The latch member generally comprises an elongate rod having a first end, a middle portion and a second end. The first end and middle portion of the rod are sized and configured to be slidably receivable into the first aperture and second aperture, respectively, of the base member. The second end of the rod is formed at approximately a ninety degree angle relative to the first end and middle portion of the rod. Attached to the second end of the rod is a disc member. The disc member defines an inner surface and an outer surface and is attached to the second end of the rod in a manner wherein the inner surface of the disc member has an orientation generally perpendicular to the first end and middle portion of the rod.

Attached to the middle portion of the rod is a stop means which is used to maintain the latch member within the base member in a fixed orientation. In the preferred embodiment, the stop means comprises a cylindrical member which has a diameter not exceeding the diameter of the rod. The cylindrical member is attached to and extends outwardly from the middle portion of the rod. The cylindrical member is positioned on the middle portion at a location wherein the cylindrical member will be in simultaneous contact with the first flange portion and inner surface of the center portion of the base member when the latch member is disposed in the unlocked position. Similarly, the cylindrical member will be in simultaneous contact with the second flange portion and the inner surface of the center portion of the base member when the latch member is disposed in the locked position. The latch member and cylindrical member attached thereto are interfaced to the base member in a manner wherein the second end of the rod is disposed in a first position when the latch member is in the unlocked position and in a second position when the latch member is in the locked position. In the preferred embodiment, the second position is oriented approximately one hundred and eighty degrees (180°) relative to the first position.

When the latch mechanism is disposed in its locked position, the inner surface of the disc member is firmly abutted against the storage unit in a manner maintaining the unit in a closed configuration. In this regard, the inner surface of the disc member is provided with a layer of cushioning material thereon to prevent damage to the exterior surface of the storage unit when the latch member is disposed in the locked position. Additionally, the cylindrical member is connected to the middle portion of the rod in a manner wherein the latch member will default to the unlocked position, such default being facilitated by the weight of the disc member. The outer surface of the disc member is preferably coated with a highly visible, reflective material so that the relative positioning of the disc member (i.e. the locked position or the unlocked position) may be readily ascertained by a laboratory technician or other observer.

It is an object of the present invention to provide a latch mechanism for maintaining laboratory storage units in a closed configuration wherein the holding force exerted by the latch mechanism may not be overcome by sudden shocks or movements.

Another object of the present invention is to provide a latch mechanism which may be easily and quickly interfaced to an existing laboratory storage unit.

Another object of the present invention is to provide a latch mechanism adapted to provide a quickly ascertainable visual indication of whether a laboratory storage unit is in a closed configuration.

Further objects and advantages of the invention will become apparent to those skilled in the art upon reading and consideration of the following description of a preferred embodiment and the accompanying drawings.

BRIEF DESCRIPTION OF THE DRAWINGS

These as well as other features of the present invention will become apparent upon reference to the drawings wherein:

FIG. 1 is a perspective view of a controlled environment storage unit having the latch mechanism of the present invention connected thereto;

FIG. 2 is a perspective view of the latch mechanism of the present invention in the locked position;

FIG. 3 is a perspective view of the latch mechanism of the present invention in the unlocked position;

FIG. 4 is a perspective view illustrating the adhesive layer disposed on the base member of the latch mechanism;

FIG. 5 is a perspective view of the latch member of the latch mechanism; and

DETAILED DESCRIPTION OF THE PREFERRED EMBODIMENT

Figure 6:
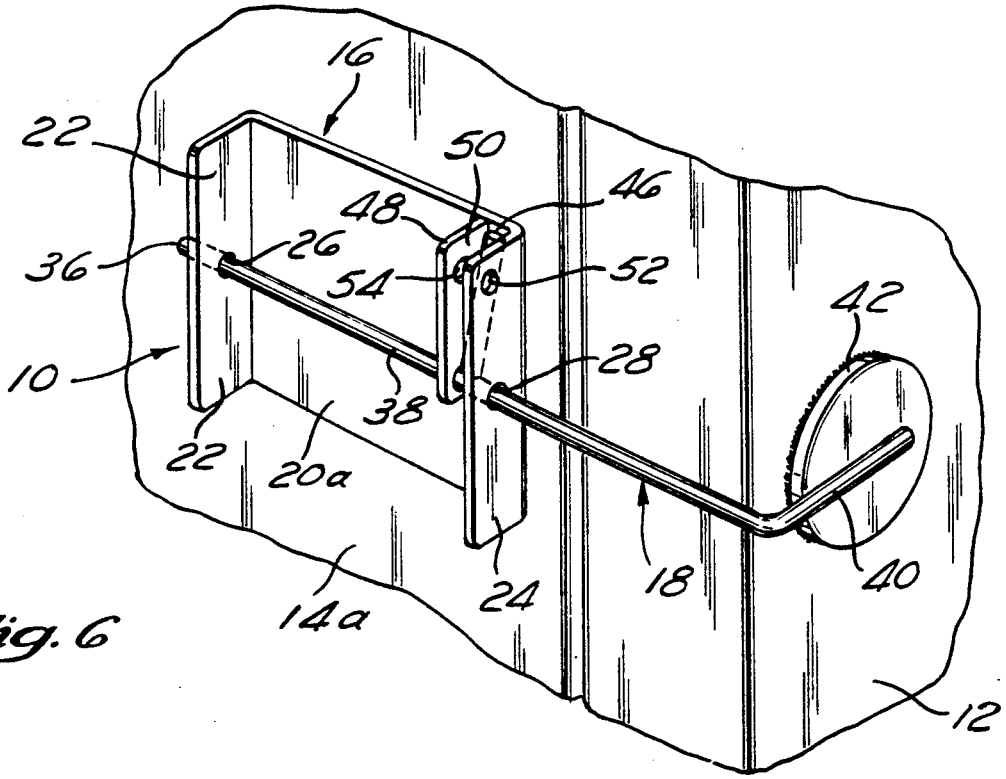
FIG. 6 is a perspective view of a latch mechanism of the present invention, further illustrating a locking member for maintaining the latch member in the locked position.

Referring now to the drawings wherein the showings are for purposes of illustrating a preferred embodiment of the present invention only and not for purposes of limiting same, FIG. 1 perspectively illustrates a latch mechanism 10 constructed in accordance with the preferred embodiment of the present invention as interfaced to a door 12 of a laboratory storage unit 14. Though laboratory storage unit 14 as shown has the configuration of an environmentally controlled storage unit (i.e. a refrigerator, incubator) it will be appreciated that latch mechanism 10 as hereinafter described may also be used in conjunction with storage units such as cabinets, drawers, etc. Latch mechanism 10 generally comprises a base member 16 (shown in FIG. 4) having a latch member 18 (shown in FIG. 5) connected thereto.

In the preferred embodiment, base member 16 comprises a generally planar center portion 20 having an inner surface 20*a* and an outer surface 20*b*. Extending perpendicularly from inner surface 20*a* of center portion 20 is a first flange portion 22 and a second flange portion 24 which are formed on the opposed ends of center portion 20 in substantially parallel relation. Disposed within first flange portion 22 is a first aperture 26 which extends therethrough, while disposed within second flange portion 24 is a second aperture 28 which extends therethrough. First aperture 26 and second aperture 28 are positioned in coaxial alignment within first flange portion 22 and second flange portion 24, respectively. As seen in FIG. 4, outer surface 20*b* of center portion 20 includes an adhesive layer 30 disposed thereon which is used to secure base member 16 to a generally planar vertical side surface 14*a* of storage unit 14. Adhesive layer 30 is exposed by removing a conventional cover sheet 32 therefrom. Though not shown, as an alternative to adhesive layer 30, center portion 20 of base member 16 may be provided with one or more apertures disposed therein which are sized and configured to receive mechanical fastening members to secure base member 16 to the storage unit 14.

Latch member 18 generally comprises an elongate rod 34 having a first end 36, a middle portion 38, and a second end 40. First end 36 and middle portion 38 are sized and configured to be slidably received within first aperture 26 and second aperture 28 of base member 16. Second end 40 is preferably formed at approximately a ninety degree angle relative to first end 36 and middle portion 38. Attached to second end 40 of rod 34 is an abutment member or disc member 42 having an inner surface 42*a* and an outer surface 42*b*. In the preferred embodiment, second end 40 of rod 34 is attached to outer surface 42*b* of disc member 42 such that inner surface 42*a* is disposed in a generally perpendicular orientation to first end 36 and middle portion 38 of rod 34. Additionally, disposed on inner surface 42*a* of disc member 42 is a layer of cushioning material 44.

Attached to and extending outwardly from middle portion 38 of rod 34 is a generally cylindrical stop member 46 having a diameter not exceeding the diameter of rod 34. Stop member 46 is used to maintain latch member 18 within base member 16 in a fixed orientation in a manner as will be described in greater detail below.

In the preferred embodiment of the present invention, latch member 18 is movable between a looked position as shown in FIG. 2, and an unlocked position as shown in FIG. 3. When in the locked position, latch member 18 is oriented such that inner surface 42*a* of disc member 42 is directly abutted against the exterior of the door 12 of storage unit 14. Importantly, stop member 46 is positioned on middle portion 38 in a location such that stop member 46 is in simultaneous contact with second flange portion 24 and inner surface 20*a* of center portion 20 when latch member 18 is in the locked position, thereby maintaining latch member 18 within base member 16. In moving latch member 18 to the unlocked position, disc member 42 is rotated approximately one hundred and eighty degrees relative to the locked position thereby removing inner surface 42*a* of disc member 42 from the abutting contact with door 12 of storage unit 14. After disc member 42 has been rotated away from door 12, latch member 18 is pushed rearwardly through first aperture 26 and second aperture 28. The unlocked orientation is achieved when stop member 46 comes in simultaneous contact with first flange portion 22 and inner surface 20*a* of center portion 20. In the preferred embodiment, stop member 46 is connected to middle portion 38 of rod 34 such that latch member 18 will automatically default to the unlocked position in a manner and for reasons which will be discussed in greater detail below.

Outer surface 42b of disc member is preferably coated with a highly visible, reflective material so that the relative positioning of latch member 18 (i.e. the locked position or the unlocked position) may be easily and quickly ascertained by a laboratory technician. Thus, due to the configuration of latch mechanism 10, upon a quick glance one may easily determine whether or not door 12 is in the closed configuration simply by observing whether disc member 42 is disposed over a portion of door 12.

Referring now to FIG. 6, base member 16 may also be provided with a locking flange 48 for purposes of maintaining latch member 18 in the locked position. Locking flange 48 extends perpendicularly from inner surface 20a of center portion 20 in an orientation substantially parallel to second flange portion 24. In this respect, locking flange 48 and second flange portion 24 form a gap 50 therebetween which is sized to receive stop member 46 when latch member 18 is disposed in the locked position. Disposed within second flange portion 24 is a first looking aperture 52 which extends therethrough, while disposed within locking flange 48 is a second locking aperture 54 which extends therethrough. First locking aperture 52 and second looking aperture 54 are positioned in coaxial alignment within second flange portion 24 and looking flange 48, respectively. First locking aperture 52 and second looking aperture 54 are adapted to receive a conventional padlock (not shown), pin or other article which is suitable to retain stop member 46 within gap 50, thereby maintaining latch mechanism 18 in the locked position.

Though latch mechanism 10 has been described as being attached to a vertical side surface 14a of storage unit 14, it will be appreciated that latch mechanism 10 may also be attached to a generally planar horizontal top surface 14b of storage unit 14. As previously specified, stop member 46 is attached to middle portion 38 of rod 34 in a manner wherein latch member 18 will default to the unlocked position. In this regard, disc member 42 is rotated slightly more than one hundred and eighty degrees (180°) when moving from the locked position to the unlocked position. Such increased rotation is needed to maintain latch mechanism 10 in the unlocked position when latch mechanism 10 is disposed upon a horizontal top surface 14b of a laboratory storage unit 14. In this regard, due to the amount of the rotation of disc member 42 exceeding one hundred and eighty degrees, the weight of disc member 42 will aid in maintaining stop member 46 against inner surface 20a of center portion 20. Latch mechanism 10 is preferably fabricated from stainless steel, though it will be appreciated that other materials will be utilized.

Additional modifications and improvements of the present invention may also be apparent to those skilled in the art. Thus, the particular combination of parts described and illustrated herein is intended to represent only one embodiment of the invention and is not intended to serve as limitations of alternative devices within the spirit and scope of the invention.

What is claimed is:

1. A latch mechanism comprising:

a base member adapted to be securable to a generally planar surface of a storage unit, said base member comprising:

(a) a generally planar center portion having an inner surface and an outer surface;

(b) first flange portion extending perpendicularly from said inner surface of said center portion, said first flange portion including a first aperture extending therethrough; and (c) a second flange portion extending perpendicularly from said inner surface of said center portion, said second flange portion being substantially parallel to said first flange portion and including a second aperture extending therethrough, said second aperture being in substantial axial alignment with said first aperture;

a latch member connected to said base member, said latch member being movable between a locked position wherein said latch member is operable to maintain said storage unit in a closed configuration, and an unlocked position wherein said storage unit may be opened, said latch member comprising:

(a) an elongate rod having a first end, a middle portion and a second end, said first end and said middle portion being sized and configured to be slidably receivable into said first aperture and said second aperture of said base member and said second end being formed at approximately a 90 degree angle relative to said first end and said middle portion; and (b) a disk member having an inner surface and an outer surface, said outer surface of said disk member being attached to said second end of said rod in a manner wherein said inner surface of said disk member has an orientation generally perpendicular to said first end and said middle portion of said rod; and a cylindrical member attached to and extending outwardly from said middle portion of said rod for maintaining said latch member within said base member in a fixed orientation, said cylindrical member having a diameter not exceeding the diameter of said rod.

2. The device of claim 1 wherein said cylindrical member is positioned on said middle portion at a location wherein said cylindrical member is in simultaneous contact with said first flange portion and said inner surface of said center portion when said latch member is in said unlocked position and in simultaneous contact with said second flange portion and said inner surface of said center portion when said latch member is in said locked position.

3. The device of claim 2 wherein said second end of said rod is disposed in a first position when said latch member is in said unlocked position and a second position when said latch member is in said locked position, said second position being oriented approximately 180 degrees relative to said first position.

4. The device of claim 3 wherein said cylindrical member is attached to said middle portion of said rod in a manner wherein the weight of said disk member is operable to maintain said latch member in said first position.

5. A latch mechanism comprising:

a base member adapted to be securable to a generally planar surface of a storage unit, said base member comprising:

(a) a generally planar center portion having an inner surface and an outer surface;

(b) first flange portion extending perpendicularly from said inner surface of said center portion, said first flange portion including a first aperture extending therethrough; and (c) a second flange portion extending perpendicularly from said inner surface of said center portion, said second flange portion being substantially parallel to said first flange portion and including a second aperture extending therethrough, said second aperture being in substantial axial alignment with said first aperture;

a latch member connected to said base member, said latch member being movable between a locked position wherein said latch member is operable to maintain said storage unit in a closed configuration, and an unlocked position wherein said storage unit may be opened, said latch member comprising:

(a) an elongate rod having a first end, a middle portion and a second end, said first end and said middle portion being sized and configured to be slidably receivable into said first aperture and said second aperture of said base member and said second end being formed at approximately a 90 degree angle relative to said first end and said middle portion; and (b) a disk member having an inner surface and an outer surface, said outer surface of said disk member being attached to said second end of said rod in a manner wherein said inner surface of said disk member has an orientation generally perpendicular to said first end and said middle portion of said rod, said outer surface being coated with a highly visible reflective material.

6. A latch mechanism comprising:

a base member adapted to be securable to a generally planar surface of a storage unit, said base member comprising:

(a) a generally planar center portion having an inner surface and an outer surface;

(b) a first flange portion extending perpendicularly from said inner surface of said center portion, said first flange portion including a first latch member receiving aperture extending therethrough;

(c) a second flange portion extending perpendicularly from said inner surface of said center portion, said second flange portion being substantially parallel to said first flange portion and including a second latch member receiving aperture and a first locking aperture extending therethrough, said second latch member receiving aperture being in substantial axial alignment with said first latch member receiving aperture; and (d) a locking flange extending perpendicularly from said inner surface of said center portion, said locking flange being substantially parallel to said second flange portion and including a second locking aperture extending therethrough, said second locking aperture being in substantial axial alignment with said first locking aperture;

a latch member slidably connected to said base member, said latch member being movable between a locked position wherein said latch member is operable to maintain said storage unit in a closed configuration and an unlocked position wherein said storage unit may be opened; and a stop means connected to said latch member for maintaining said latch member within said base member in a fixed orientation.

7. The device of claim 6 wherein said second flange portion and said locking flange define a gap therebetween, said gap being sized and configured to receive said stop means when said latch member is disposed in said locked position.

8. The device of claim 7 wherein said first locking aperture and said second locking aperture are oriented such that such stop means will be disposed between said first locking aperture, said second locking aperture and said inner surface of said center portion when said latch member is in said locked position.

9. The device of claim 8 wherein said first locking aperture and said second locking aperture are sized and configured to slidably receive a locking member for retaining said latch member in said locked position.

10. A latch mechanism for maintaining a door of a controlled environment laboratory storage unit in a closed position, said latch mechanism comprising:

a base member adapted to be securable to a generally planar surface of said storage unit;

a latch member connected to said base member, said latch member being movable between a locked position wherein said latch member is operable to maintain said door in a closed configuration, and an unlocked position wherein said door may be opened, said latch member comprising:

(a) an elongate rod having a first end, a middle portion and a second end, said second end being formed at approximately a 90 degree angle relative to first end and said middle portion; and (b) a disk member having an inner surface and an outer surface, said outer surface of said disk member being attached to said second end of said rod in a manner wherein said inner surface of said disk member has an orientation generally perpendicular to said first end and said middle portion of said rod, said inner surface of said disk member being firmly abutted against said door when said latch member is in said locked position; and a stop means connected to said latch member for maintaining said latch member within said base member in a fixed orientation.

11. The device of claim 10 wherein said inner surface of said disk member includes a layer of cushioning material thereon.

12. A latch mechanism comprising:

a base member adapted to be securable to a generally planar surface of a storage unit, said base member comprising:

(a) a generally planar center portion having an inner surface and an outer surface; and (b) a pair of flange portions extending perpendicularly from said inner surface of said center portion, said flange portions including a pair of coaxially aligned apertures extending therethrough;

an elongate latch member having a first end, a middle portion and a second end, said first end and said middle portion of said latch member being sized and configured to be slidably receivable into said pair of apertures disposed within said base member, and said second end being formed at approximately a ninety degree angle relative said first end and said middle portion, said latch member being slidably connected to said base member for movement between a locked position wherein said latch member is operable to maintain said storage unit in a closed configuration, and an unlocked position wherein said storage unit may be opened;

an elongate stop member rigidly attached to and extending to perpendicularly from said middle portion of said latch member, said stop member being sized and configured to maintain said latch member in sliding connection to said base member and to cooperate with said base member in a manner operable to orient said latch member relative said storage unit such that said latch member will maintain said storage unit in a closed configuration when in said locked position and will allow said storage unit to be opened when in said unlocked position; and an abutment member defining a first surface and a second surface, said second surface being attached to said second end in a manner wherein said first surface has an orientation generally perpendicular to said first end and said middle portion.

13. The device of claim 12 wherein said stop member is attached to said middle portion at a location wherein said stop member is confined between said flange portions during movement of said latch member between said locked position and said unlocked position, thereby maintaining said latch member within said pair of apertures disposed within said base member.

14. The device of claim 13 wherein said second end of said latch member is disposed in a first position when said latch member is in said unlocked position and a second position when said latch member is in said locked position, said second position being oriented approximately 180 degrees relative said first position.

15. The device of claim 14 wherein said stop member is attached to said middle portion in a manner wherein the weight of said abutment is operable to maintain said latch member in said first position.

16. The device of claim 12 wherein said first surface of said abutment member includes a layer of cushioning material thereon.

17. The device of claim 12 wherein said second surface of said abutment member is coated with a highly visible, reflective material.

18. The device of claim 12 wherein said abutment member has a generally circular configuration, said latch member has a circular cross-sectional configuration, and said stop member has a generally cylindrical configuration having a diameter not exceeding the diameter of said latch member.

19. A latch mechanism comprising:

a base member adapted to be securable to a generally planar surface of a storage unit, said base member comprising:

(a) a generally planar center portion having an inner surface and an outer surface;

(b) a first flange portion extending perpendicularly from said inner surface, said first flange portion including a first latch member receiving aperture extending therethrough;

(c) a second flange portion extending perpendicularly from said inner surface, said second flange portion including a second latch member receiving aperture and a first locking aperture extending therethrough, said second latch member receiving aperture being coaxially aligned with said first latch member receiving aperture; and (d) a locking flange extending perpendicularly from said inner surface of said center portion in substantial parallel relation to said second flange portion, said locking flange including a second locking aperture extending therethrough, said second locking aperture being coaxially aligned with said first locking aperture;

an elongate latch member having a first end, middle portion and second end, said latch member being slidably connected to said base member for movement between a locked position wherein said latch member is operable to maintain said storage unit in a closed configuration, and an unlocked position wherein said storage unit may be opened; and an elongate stop member rigidly attached to and extending perpendicularly from said middle portion of said latch member, said stop member being sized and configured to maintain said latch member in sliding connection to said base member and to cooperate with said base member in a manner operable to orient said latch member relative said storage unit such that said latch member will maintain said storage unit in a closed configuration when in said locked position and will allow said storage unit to be opened when in said unlocked position.

20. The device of claim 19 wherein said second flange portion and said locking flange define a gap therebetween, said gap being sized and configured to receive said stop member when said latch member is disposed in said locked position.

21. The device of claim 20 wherein said first locking aperture and said second locking aperture are oriented such that said stop member will be disposed between said first locking aperture, said second locking aperture and said inner surface of said center portion when said latch member is in said locked position.

22. The device of claim 21 wherein said first locking aperture and said second locking aperture are sized and configured to slidably receive a locking member for maintaining said latch member in said locked position.

* * * * *